US006477961B1

(12) United States Patent
Mares

(10) Patent No.: US 6,477,961 B1
(45) Date of Patent: Nov. 12, 2002

(54) AMUSEMENT RIDE

(75) Inventor: John F. Mares, Lansing, NY (US)

(73) Assignee: Meteoro Amusement Corporation, Lansing, NY (US)

( * ) Notice: Subject to any disclaimer, the term of this patent is extended or adjusted under 35 U.S.C. 154(b) by 0 days.

(21) Appl. No.: 10/178,314

(22) Filed: Jun. 21, 2002

Related U.S. Application Data

(63) Continuation of application No. 10/057,010, filed on Jan. 24, 2002, which is a division of application No. 09/814,083, filed on Mar. 21, 2001, now Pat. No. 6,386,115, which is a continuation of application No. 09/219,297, filed on Dec. 21, 1998, now Pat. No. 6,227,121, which is a continuation-in-part of application No. 09/098,043, filed on Jun. 16, 1998, now Pat. No. 6,098,549, which is a continuation-in-part of application No. 08/742,465, filed on Nov. 1, 1996, now Pat. No. 5,791,254.

(60) Provisional application No. 60/007,206, filed on Nov. 3, 1995, and provisional application No. 60/050,980, filed on Jun. 20, 1997.

(51) Int. Cl.[7] ..... A63G 25/22

(52) U.S. Cl. ..... 104/76

(58) Field of Search ..... 104/53, 55, 56, 104/57, 58, 62, 63, 64, 65, 66, 74, 84, 75, 83, 76, 77, 78; 105/149.1, 149.2

(56) References Cited

U.S. PATENT DOCUMENTS 5,272,984 A * 12/1993 Bolliger et al. ..... 104/63
6,158,354 A * 12/2000 Eiraku ..... 104/53

FOREIGN PATENT DOCUMENTS

WO WO 01/08769 * 2/2001

* cited by examiner

*Primary Examiner*—Mark T. Le
(74) *Attorney, Agent, or Firm*—George R. McGuire; Hancock & Estabrook, LLP

(57) ABSTRACT

An amusement device comprising a modularized pod at least one of which are attached to each side of a carriage that travels along a track. The pods are each mounted to the carriage for 360° that are interconnected to the side walls of a carriage that rides along a track in a predetermined direction of travel. One or more riders sit and are restrained in the pods which are capable of spinning 360 degrees about a horizontal axis that extends transverse to the direction of travel. The riders may control the spinning of the pod, either forward or backward, by pressing buttons on the passenger's handgrips located inside the pod.

4 Claims, 17 Drawing Sheets

AMUSEMENT RIDE

CROSS-REFERENCE TO RELATED APPLICATIONS

This application is a continuation application of Applicant's co-pending application, U.S. patent application Ser. No. 10/057,101, filed Jan. 24, 2002, which is a divisional application of U.S. patent application Ser. No. 09/814,083, filed Mar. 21, 2001 now U.S. Pat. No. 6,386,115, which is a continuation application of U.S. patent application Ser. No. 09/219,297, filed on Dec. 21, 1998, entitled "Modular Amusement Ride and Training Simulation Device", and issued as U.S. Pat. No. 6,227,121, which is a continuation-in-part of U.S. patent application Ser. No. 09/098,043, entitled "Modularized Amusement Ride and Training Simulation Device", filed Jun. 16, 1998, and issued as U.S. Pat. No. 6,098,549, which is a continuation-in-part application of U.S. patent application Ser. No. 08/742,465, entitled "Full Range of Motion Roller Coaster", filed Nov. 1, 1996, and issued as U.S. Pat. No. 5,791,254 on Aug. 11, 1998, which claimed the benefit of the filing of Provisional Application Serial No. 60/007,206, entitled "Amusement or Basic Transportation Device Using a Ball (Sphere) and Track or Tube", filed on Nov. 3, 1995, which are all incorporated herein by reference. U.S. patent application Ser. No. 08/742,465 also claimed the benefit of the filing of Provisional Application Serial No. 60/050,980, entitled "Modularized Amusement Ride Device", filed on Jun. 20, 1997, which is also incorporated herein by reference.

BACKGROUND OF THE INVENTION

1. Field of the Invention (Technical Field)

The present invention relates to amusement apparatuses, such as carrousels, ferris wheels, centrifugal tumblers, virtual reality arcade and motion picture devices, roller coasters, and flight training and simulation systems.

2. Background Art

A problem with many amusement devices is that they are static in that the rider achieves substantially the same ride each time. Certain rides permit some degree of passenger control, such as the ubiquitous Tilt-A-Whirl® found at many fairs and amusement parks.

The present invention permits the creation of rides, both new and retrofitted, in which the passenger may spin in a pod in a manner controlled by the passenger and independent of other passengers. This is achieved by motor control of a brake system by the passenger of a pod which rotates about an axle at substantially the center of gravity of the pod.

Examples of rides which provide some rotation capabilities, with or without passenger control, are U.S. Pat. No. 4,545,574, to Sassak (spherical body with no axle); U.S. Pat. No. 4,501,434, to Dupuis (spherical body spinning about a bottom connection); U.S. Pat. No. 4,170,943, to Achrekar (pods swinging about an end thereof); U.S. Pat. No. 2,499,470, to Duncan (spherical body rotating about trunnions, like a cannon); U.S. Pat. No. 2,498,450, to Pewitt (rotation not about an axle and apparently not about a point substantially at the center of gravity); U.S. Pat. No. 2,135,230, to Courtney (swingable seats about a point near the top of the seat); and U.S. Pat. No. 142,605, to Yates (rotation about pivots with no passenger control).

SUMMARY OF THE INVENTION (DISCLOSURE OF THE INVENTION)

The present invention is of an amusement device comprising: a seat for at least one passenger; a frame for supporting the seat; an axle attached to a carriage, the frame attached to and fully rotatable about the axle; a track allowing the carriage to travel; carriage contacts for disposing the carriage on the track; the frame being fully rotatable about the axle and at substantially the center of gravity of the frame and the seat; and a control device for selectively allowing and preventing free rotation of the frame about the axle. In the preferred embodiment, the seat comprises a restraint for restraining the passenger through motions in all three planes. The seat may be for multiple passengers. The carriage contacts comprise at least one set of wheels and the track comprises a rail disposed between the wheels of the at least one set of wheels, with the wheels preferably being concave-shape and the rail tubular or box shaped. The control device preferably comprises a brake system for braking rotation of the seating means about the axle, with the brake system being activated by passenger activation of the control device, such as by a combination of a passenger pull lever, a disk brake, and calipers which engage with the disk brake when the passenger pulls on the lever. The brake system is preferably activated by a motor, which may be programmable.

The present invention is also of an amusement device comprising: a seat for at least one passenger; a frame for supporting the seating means; an axle about which the frame is freely rotatable, the axle being attached to a carriage; and a brake system connected to at least one of the frame and carriage; wherein the frame is fully rotatable about the axle and at substantially a center of gravity of the frame and the seat. In the preferred embodiment, a motor is employed which, when engaged by a passenger, is capable of pushing the frame around the axle forward and backward and of temporarily locking the frame to the axle and when released returns the frame and the seating means to a relative upright and neutral position. The device may be attachable by the axle to amusement rides such as carrousels, Ferris wheels, centrifuge devices, and sets of height and swivel adjustable legs. A computer electronically attached to the device preferably tracks the flight path and spins of the device and outputs the flight path and spins of the device. The computer can also generate and transmit virtual reality images to the passenger. Control means are preferably provided for controlling the brake system, most preferably by passenger activation of the control means, which may comprise a passenger pull lever, a disk brake, and calipers which engage with the disk brake when the passenger pulls on the lever.

An objective of the present invention is to create a new amusement device and flight/space training and simulation device. The device presents the rider with the opportunity to control his/her own ride, to the extent that the rider can choose whether to spin the device forward or backward or whether to spin at all. This device liberates the rider from simply being strapped into a seat, which locks the rider's body into a single position relative to the carriage in which the rider sits. And, for the first time, riders who are seated in otherwise typical amusement rides, such as carrousels, Ferris wheels, zippers, centrifugal rides and the like, may spin at will, without the need for gravity assistance. This device also presents flight and space training and simulation devices the opportunity to create unusual attitude experiences for trainees.

The objective of the invention is attained in part by providing a modularized pod which is capable of containing one or more riders and which spins under power, and at the riders' control, about a an axis which is horizontal, relative to the rider's seated position. The modularized pod may be built to contain a single rider, or multiple riders, depending upon the owner's desire.

The objective of the invention is further attained by creating a device which is capable of working in conjunction with many different devices, including, but not limited to roller coasters, carrousels, Ferris wheels, virtual reality units, centrifugal tumblers. The device may also be used in conjunction with flight and space training and simulation units. This versatile unit is therefore capable of being used for a variety of applications.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figures 1, 2, 3:
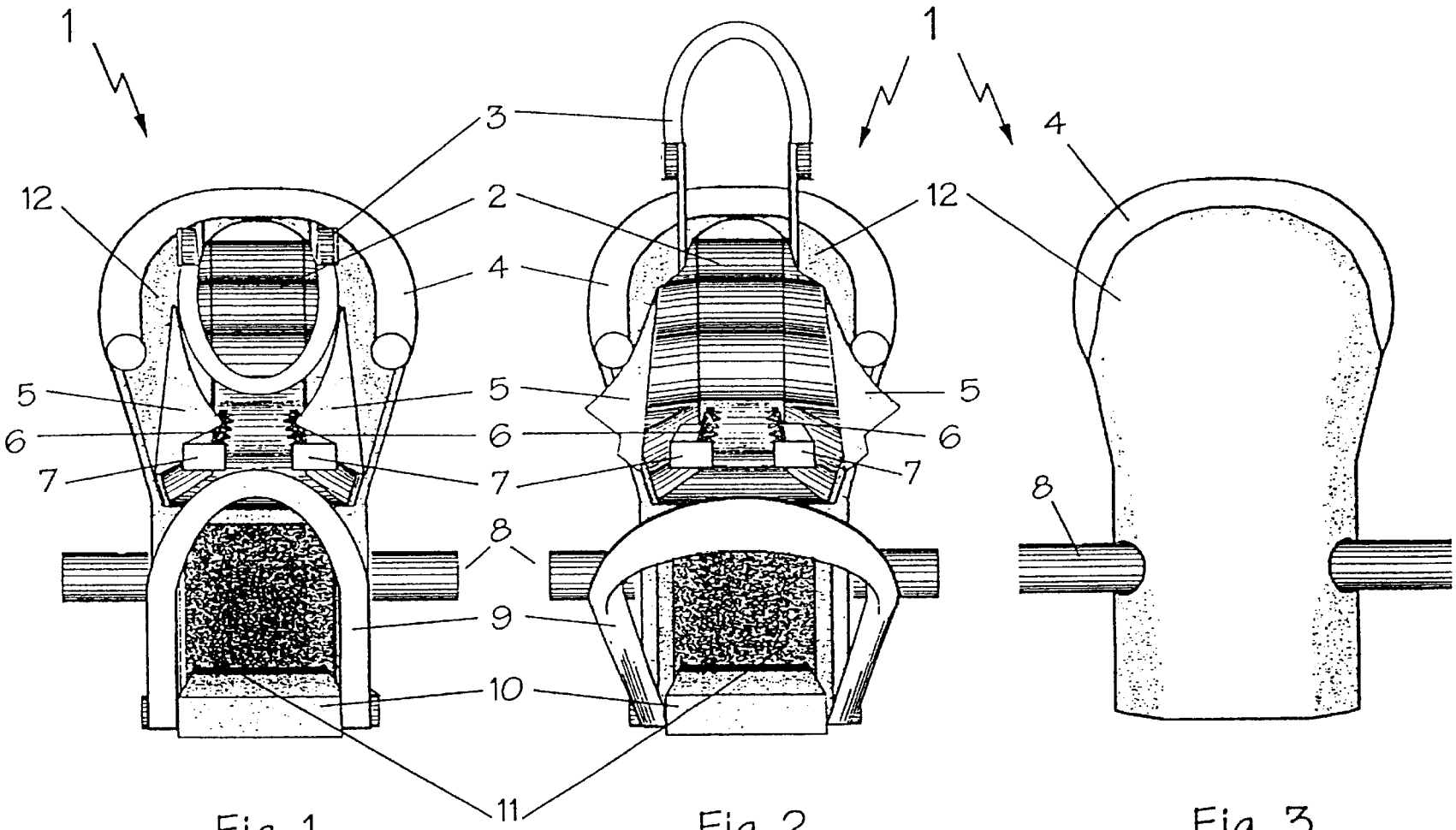
FIG. 1 is a front view of a modularized pod which is configured for a single rider, the pod in a closed and locked position.
FIG. 2 is a front view of the pod as depicted in FIG. 1 in an open position, the pod being open and ready for a rider to enter and be seated.
FIG. 3 is a back view of the pod as depicted in FIG. 1 in a closed and locked position.

DESCRIPTION OF THE PREFERRED EMBODIMENTS (BEST MODES FOR CARRYING OUT THE INVENTION)

The present invention is a modularized amusement ride and training simulation device comprising an axle about which spins a frame and a body attached to the frame which allows a pilot to enter and exit, a seat within the body for seating at least one pilot riding inside who activates and controls the spin of the seat, a means for pilot control of the spin of the frame, such as hand controls, a means for propelling the spin of the frame, either forwards or backwards, such as an electric or an hydraulic motor, a means for stopping and locking the frame at any attitude about the axle, a means for releasing the about the axis so that the frame returns to a relative upright and neutral position in the event the pilot releases the hand controls, a restraint or harness system which restrains the pilot on the seat and within the confines of the body, the sum of which comprises a modularized spinning pod device ("Pod"). For simple amusement purposes, the pilot may control the spin of the Pod about in one plane about an axle; for more complex amusement devices and for flight training and simulation, the pilot may control the Pod's attitude in one, two or three dimensions.

Alternatively, the Pod may be automatically activated to spin or come to rest by a motor, which is controlled by a programmed set of commands. The Pod may be arranged and placed with sets of other Pods for amusement rides, such as carrousels, Ferris wheels, roller coasters, centrifugal tumbling devices, or upon moving platforms, such as a "moving sidewalk" or the bed or a truck. The Pod may be used in an arcade environment, placed in conjunction with a virtual reality computer generated simulation. Alternatively, the Pod may be used for flight simulation in three dimensions.

In a roller coaster configuration, the roller coaster may comprise a clear tube in which at least a portion of the track is disposed, surrounded by a fluid or a solid. The roller coaster may comprise at least two track systems, each of the track systems supporting an independent roller coaster ride.

A capsule, or pod, concept can be built as a unitized module. Such a pod can be utilized in amusement machines such as roller coasters and in other devices and for other purposes as well. For example, current day rides, such as a Ferris Wheel, a merry-go-round, a carousel, or other turning or spinning amusement rides can be retrofitted with pods in order to create new and amusing effects.

Further, a pod can be combined with three dimensional "virtual reality" computer generated images in order to produce a completely new amusement device, one in which the occupant of the pod can simultaneously experience physical tumbling and spinning while "riding" computer generated amusement rides or experiences. The computer generated graphics concerning the movements and tumbling effects of the pod may be used for personal computer game generation and use, such as building and riding computerized roller coasters and other amusement devices.

The pod may, for example, be created as follows: place a capsule capable of containing a human being on an axle which is placed under the occupant's seat. The capsule has a seat which is designed along the concept of the couches upon which astronauts sit. The occupant is held into the capsule by means of a five-point safety harness system, an inflatable bladder which encircles and positions the occupant's head, a foot rest, and two doors, or wings, which hinge along the outside of the occupant's shoulders down to the occupant's feet, which open outward to allow entry into the capsule. Upon entry into the capsule, and after fastening the five-point safety harness, the occupant closes the two wings over the occupant in order to restrain the occupant's arms and legs within the confines of the capsule. The bladder is then automatically inflated about the occupant's head in order to restrain the occupant's head within the capsule.

Once restrained within the capsule, the occupant has controls at the occupant's fingertips which allow the occupant to spontaneously control the tumbling motion of the capsule, either forward, backward or no tumbling at all. In addition, the tumbling effect could be controlled by the amusement ride operator, or by a computer, with either preprogrammed or spontaneous tumbling or spinning effects.

A capsule is driven about the axle upon which it rests by a system of motors, gears, electronic controls and possibly chains or pulleys in order to physically drive the capsule around the axle. The capsule is programmed to return to an upright and locked position for occupant entry and departure as well as whenever power is lost to the device.

A capsule, or pod, can be individually installed or may be combined with other pods, devices, or machines in order to create new amusement rides or to retrofit older rides. One completely new ride which may be created is as follows: Place a pod at the end of an axle, which is connected to spinning shaft, which is installed within a frame which rolls upon a track. This device allows the occupant of each pod to simultaneously tumble, spin, move forward or backward and to rise and fall with the motion of the device on the track.

Now referring to the figures, the present invention is of a modularized pod in which the rider(s) have control of the pod over a range of motor-driven motion in one or more axes. In the preferred embodiment, the range of motor-driven motion is in a single axis about an axle.

FIG. 1 shows the preferred pod assembly 1 of the pod as configured for a single rider. Pod 1 is comprised of a seat for a single rider 2, a head, neck and chest restraint bar assembly 3, a protective top cushion 4, which is mounted on the pod body 12, two retractable arm restraints 5, two hand grips with respective spin control buttons 6, two armrests 7, an hollow axle 8 about which Pod 1 spins, a leg and lap restraint bar 9, a protective foot restraint box 10, and a back-of-leg kick restraint plate 11, which connects to the pod body 12.

Access to the pod is via the side or the front. Restraints 3 and 9 may be of any type known to the art, taking into account that the rider rotate the pod upside down, and the pod may be moved horizontally, vertically and laterally at times by the particular mechanism to which the pod is attached. Thus, restraints 3 and 9 may be rigid (e.g., bars) or flexible (e.g., straps) or any combination of the two. Likewise, seat 2 may be contoured, provided with padding, bracing, support and the like, in order to provide for rider comfort and safety. The terms "seat," "seating means" and "seating" as used throughout the specification and claims, are intended to mean the rider carrier for sitting or standing or being in a prone position, that is the position in which a rider rides an amusement device, such as a roller coaster, carousel, Ferris wheel, or the like and is limited to the common meaning of "seat" but rather that the rider is "seated" or disposed within the pod.

FIG. 2 illustrates Pod 1 where restraints 3, 5, and 9 are open and ready for a rider to enter the pod and to subsequently strap or bar herself into place. FIG. 3 illustrates the back view of Pod 1 where restraints 3, 5, and 9 are closed and are thus not visible to the viewer from this point of view.

Figures 4, 5:
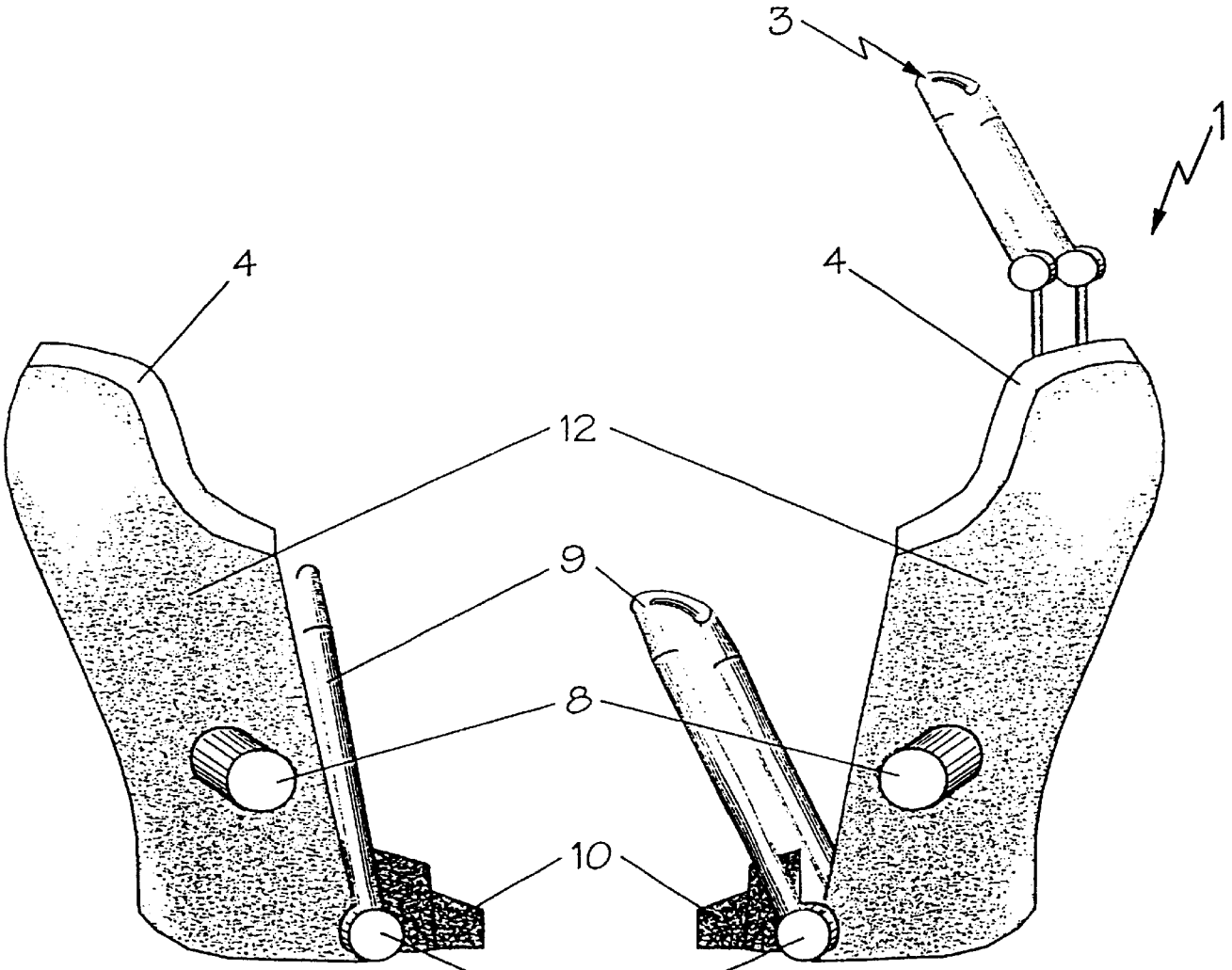
FIG. 4 is a side view of the pod as depicted in FIG. 1 in a closed and locked position.
FIG. 5 is a side view of the pod as depicted in FIG. 1 in an open position.

FIG. 4 illustrates the side view of Pod 1 where restraints 3, 5, and 9 are closed. FIG. 5 illustrates the side view of an open Pod 1 as depicted in FIG. 2. In FIG. 5, pivot 13 acts to allow leg and lap restraint 9 to tilt outward, down and away from the pod in order to allow rider entrance into the pod. FIG. 5 also depicts head, neck and chest restraint bar assembly 3 in a raised and open position.

Figure 6:
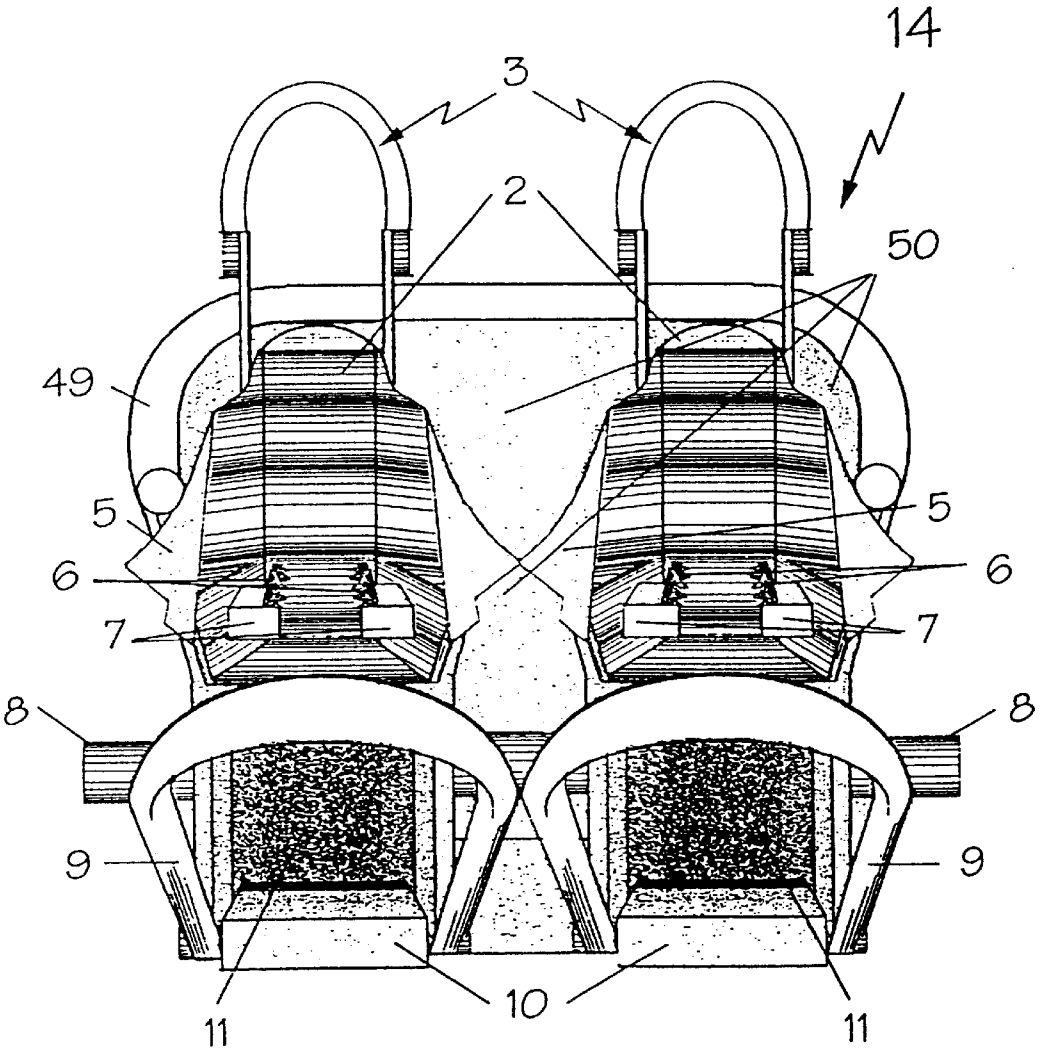
FIG. 6 is a front view of a modularized pod, which is configured for two riders; the pod being in an open position, ready for two riders to enter and be seated.

FIG. 6 illustrates the front view of a preferred pod assembly 14 of the pod as configured for two riders. Pod 14 is comprised of two seats 2, for two riders, two head, neck and chest restraint bar assemblies 3, dual protective top cushion 49, which is mounted on the pod body 50, four retractable arm restraints 5, four hand grips with respective spin control buttons 6, four armrests 7, an hollow axle 8 about which Pod 14 spins, a two leg and lap restraint bars 9, two protective foot restraint boxes 10, and two back-of-leg kick restraint plates 12, which connect to the dual pod body 50.

Figures 7, 8:
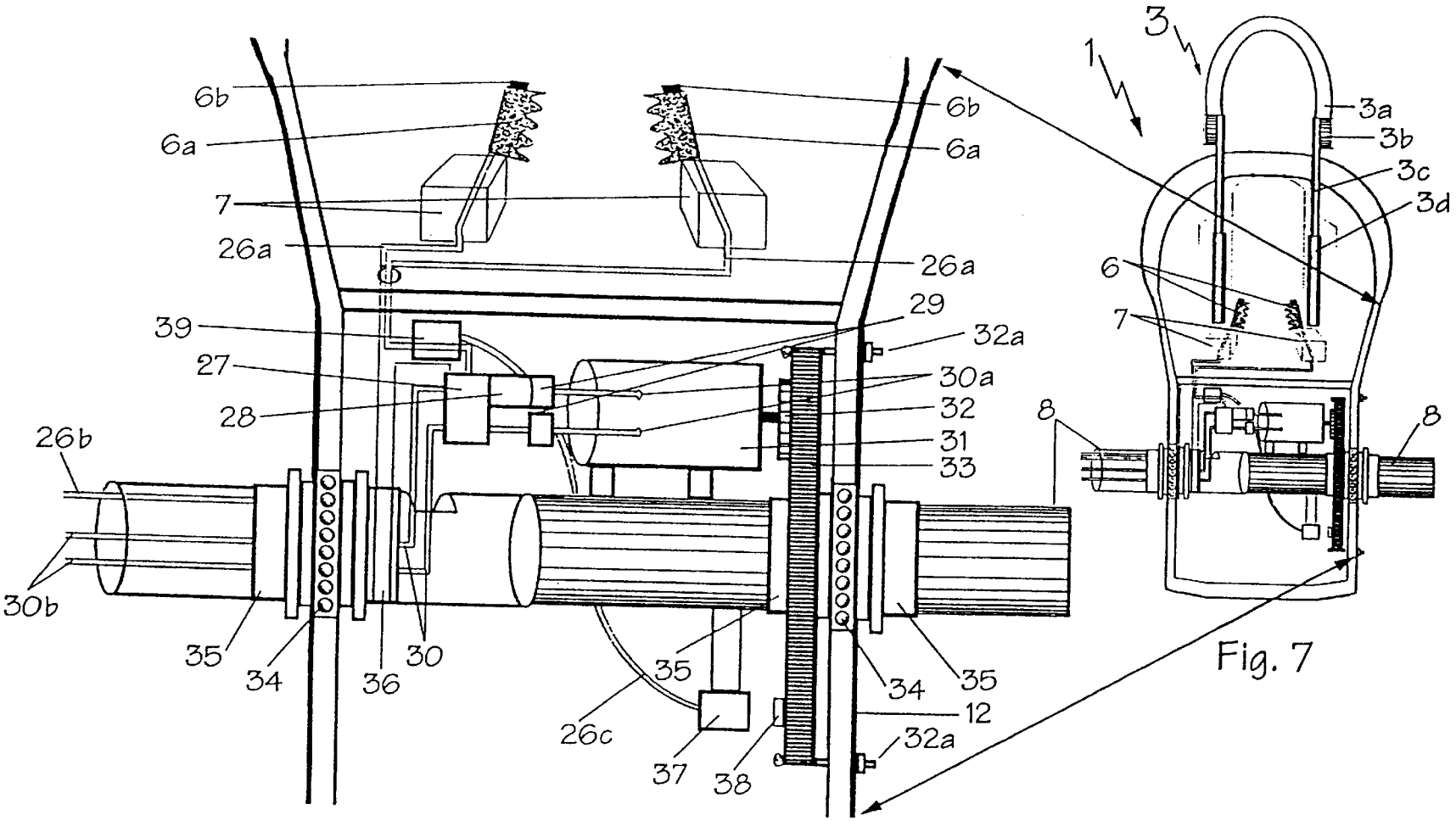
FIG. 7 is a cut-away view of the rear of the pod as depicted in FIG. 3 which reveals the working inner mechanisms of a pod.
FIG. 8 is an expanded, cut-away view of the working inner mechanisms of the pod as depicted in FIG. 7.

FIG. 7 illustrates a cut-away view of the rear of the pod as depicted in FIG. 3 which reveals the working inner mechanism of Pod 1 as well as the working mechanism of head, neck and chest restraint bar assembly 3. Head, neck and chest restraint collar 3*a* is connected to pivots 3*b*, which are connected to telescoping pistons 3*c*, which raise and lower within cylinders 3*d*. In order to raise restraint assembly 3, collar 3*a* pivots upward on pivots 3*b*, while telescoping pistons 3*c* raise upward within cylinders 3*d* in order to allow a rider enter and sit in Pod 1.

Figure 9:
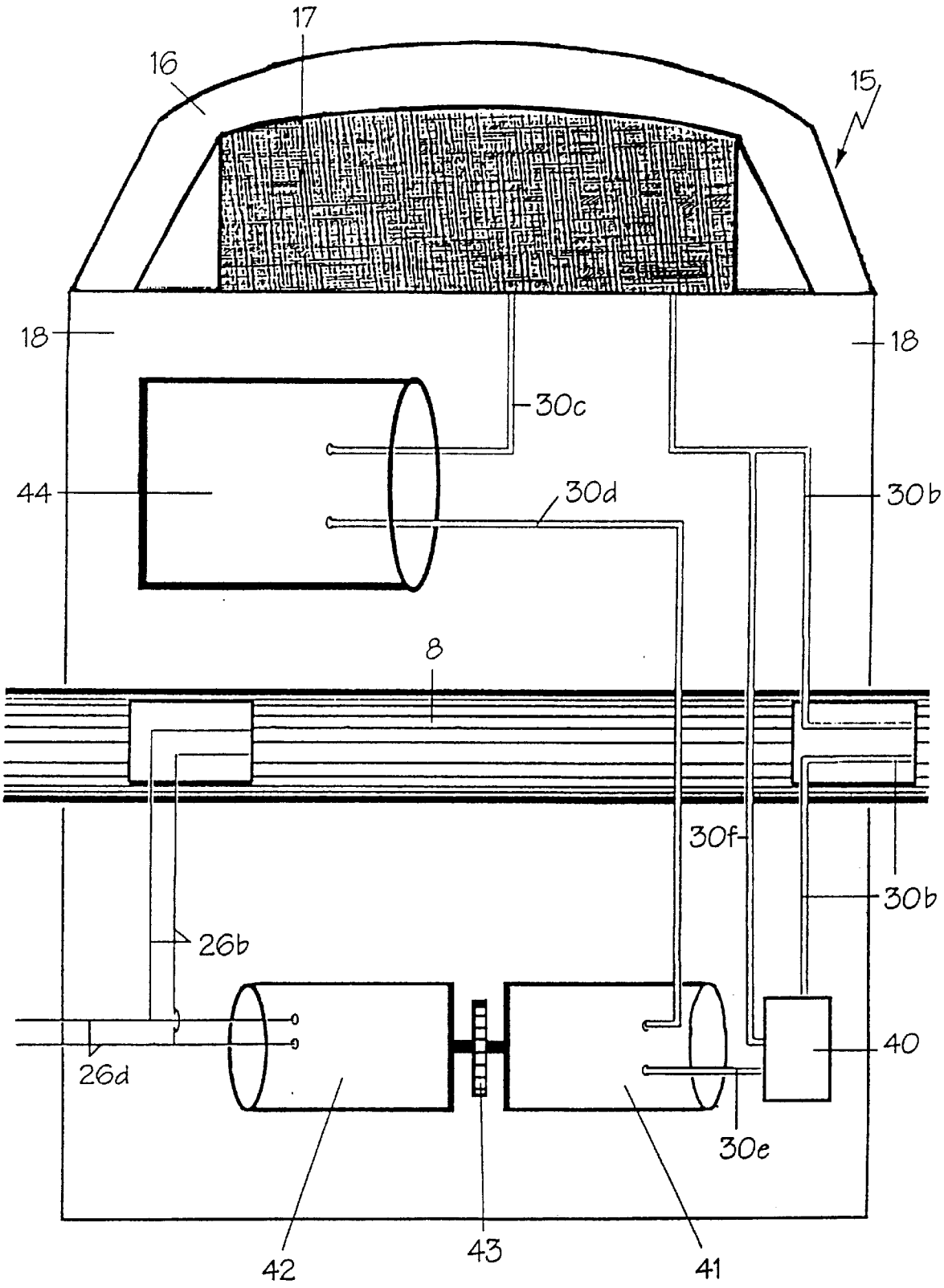
FIG. 9 is detailed overhead view of the hydraulic pump box, which is connected to the pod by hydraulic and electrical lines, but which is placed in an area separate from the pod.

FIG. 8 is an expanded, cut-away view of the working inner mechanism of the pod as depicted in FIG. 7. Spin control button 6*b,* which is attached to handgrip 6*a,* transmits an electrical signal via electrical wires 26*a,* through hand control override switch box 39, to a four-way hydraulic fluid direction control valve 27. Valve 27 opens to allow hydraulic fluid to pass into hydraulic flow control valve 28, through a hydraulic fluid accumulator 29, through hydraulic fluid lines 30*a,* into hydraulic motor 31. Hydraulic motor 31 drives gear 32, which connects to, and drives, ring gear 33. Ring gear 33 is connected to body 12 via a set of connecting bolts 32*a.* Body 12 rotates about hollow axle 8 via the pod 1 axle roller bearing assembly 34. Roller bearing assembly 34 is held in place with pod/axle restraint collars 35. Electrical current is obtained for spin control button 6*a* and for hand control override box 39 via brush contacts with slip ring 36, which obtains electrical power via electrical wires 26*b,* which are positioned inside hollow axle 8. Hydraulic fluid lines 30*b* carry hydraulic fluid to and from valve 27 from hydraulic pump box 15, which is depicted in FIG. 9. Electric positioning sensor 37 detects the position of gear ring positioning reflector 38. Electric positioning sensor 37 transmits electrical signals via electrical wires 26*c* to hand control override box 39.

FIG. 9 illustrates a detailed overhead view of hydraulic pump box assembly 15, which is connected to a pod by hydraulic fluid lines 30*b,* electric lines 26*b* and by hollow axle 8, which rests upon, and is attached to the floor pan 18 of hydraulic pump box assembly 15. Hydraulic fluid travels to and from valve 27, as depicted in FIG. 8, via hydraulic fluid lines 30*b.* Hydraulic fluid lines 30*b* carry hydraulic fluid to and from hydraulic pressure relief valve 40 and hydraulic fluid radiator 17. Hydraulic fluid line 30*c* carries hydraulic fluid from radiator 17, which is situated between cowling 16 and floor pan 18 of hydraulic pump box 15, to hydraulic fluid reservoir 44. Hydraulic fluid line 30*d* carries hydraulic fluid from reservoir 44 to hydraulic pump 41, which is driven by electric motor 42 via power transfer mechanism 43. Hydraulic pump 41 pumps hydraulic fluid via hydraulic line 30*e* to pressure relief valve 40. Hydraulic line 30*f* acts as a return line for hydraulic fluid to pressure relief valve 40 in the event hydraulic pressure builds in the hydraulic fluid system. Electric motor 42 is powered from an outside electrical power source via electrical lines 26*d,* which also transfer electrical power to switch box 27, spin control buttons 6*a* and to hand control override box 39, which is depicted in FIG. 8.

The following occurs when a rider in a pod activates a spin control button 6*a.* Button 6*a* transmits a signal through hand control override box 39, to four-way hydraulic fluid direction control valve 27. Fluid direction control valve 27 releases hydraulic fluid into hydraulic flow control valve 28. Flow control valve 28 releases hydraulic fluid into hydraulic fluid accumulator 29 and then via hydraulic fluid line 30*a* into hydraulic motor 31. Hydraulic motor 31 then drives drive gear 32, which in turn drives ring gear 33, thereby turning pod body 12 about hollow axle 8, as ring gear 33 is connected to pod body 12 with connecting bolts 32*a.* Hydraulic fluid is transferred from hydraulic pump box 15 depicted in FIG. 9 to the hydraulic spinning mechanism depicted in FIG. 8.

In the event a rider releases both spin control buttons 6*a,* positioning sensor 37 senses whether ring gear positioning reflector 38 is immediately in front of positioning sensor 37, which means that Pod 1 is in a relative upright position, and if not, then an electric signal is relayed to hand control override switch box 39 via electrical wires 26. Hand control override switch box 39 then directs fluid direction control valve 27 to release hydraulic fluid into hydraulic flow control valve 28. Flow control valve 28 releases hydraulic fluid into hydraulic fluid accumulator 29 and then via hydraulic fluid line 30*a* into hydraulic motor 31. Hydraulic motor 31 then drives drive gear 32, which in turn drives ring gear 33, thereby turning pod body 12 about hollow axle 8 until pod body 12 is in a relative upright position, as indicated when ring gear positioning reflector 38 is immediately in front of positioning sensor 37, and hand control override switch box 39 shuts off. An electric motor or other power drive device may be employed rather than the preferred hydraulic motor.

Figure 10:
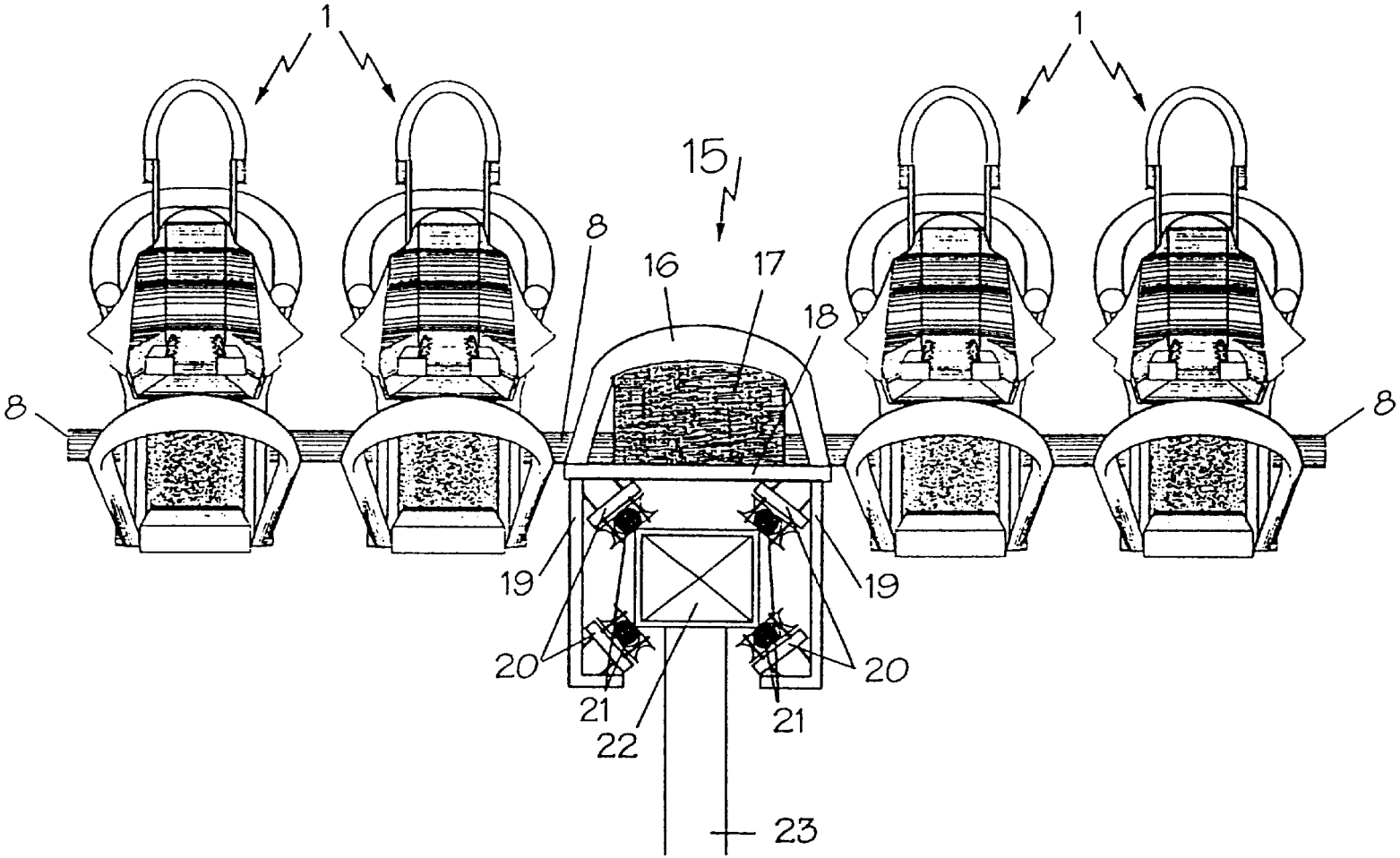
FIG. 10 is a front view of a set of four pods, which are configured for single riders, as depicted in FIG. 2, and which are placed upon a roller coaster carriage, which travels upon an innovative monorail track.

FIG. 10 illustrates a front view of four pods 1, which are configured for single riders, as depicted in FIG. 2, and which are placed upon a roller coaster carriage consisting of hydraulic pump box 15 and monorail carriage 19, which travels upon monorail track structure 22, which is supported by track support pylon 23. Monorail carriage 19 is attached to roller assemblies 20, which encapsulate and roll upon rails 21, which are attached to monorail track structure 22.

Figure 11:
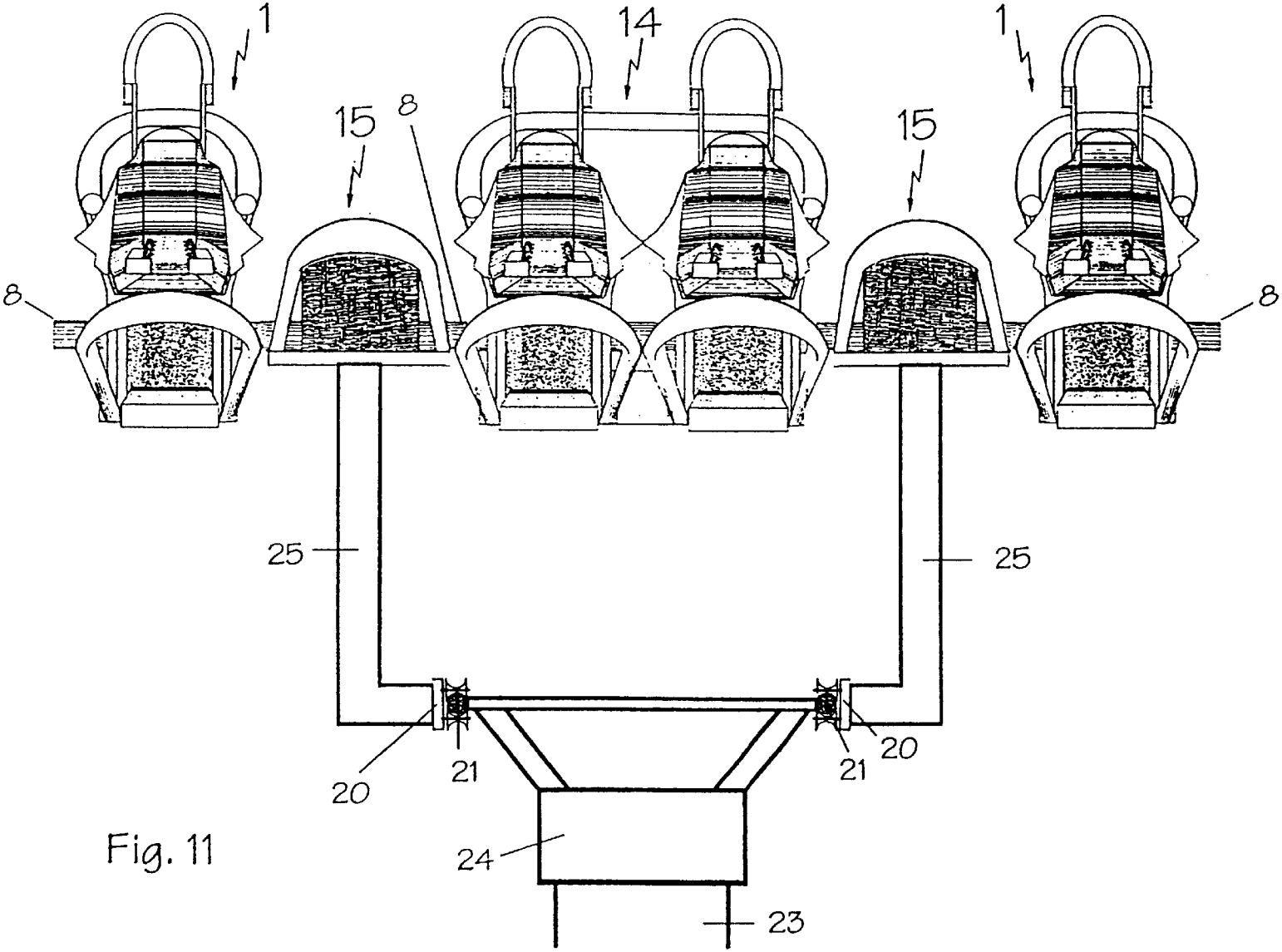
FIG. 11 is a front view of a set of three pods, one of which is configured for two riders as depicted in FIG. 6, and two of which are configured for single riders as depicted in FIG. 2; the set of three pods is placed upon a roller coaster carriage which travels on a traditional two rail, steel roller coaster track.

FIG. 11 is a front view of a set of three pods, one of, which is a Double Pod 14 as depicted in FIG. 6, and two of which are Pod 1, as depicted in FIG. 2, and which are placed upon two rollercoaster carriages consisting of hydraulic pump box 15 and dual rail carriage support legs 25, which travel upon traditional dual rail track structure 24, which is supported by track support pylon 23. Dual rail carriage support legs 25 are attached to roller assemblies 20, which encapsulate and roll upon rails 21, which are attached to traditional dual rail track structure 24.

Figure 12:
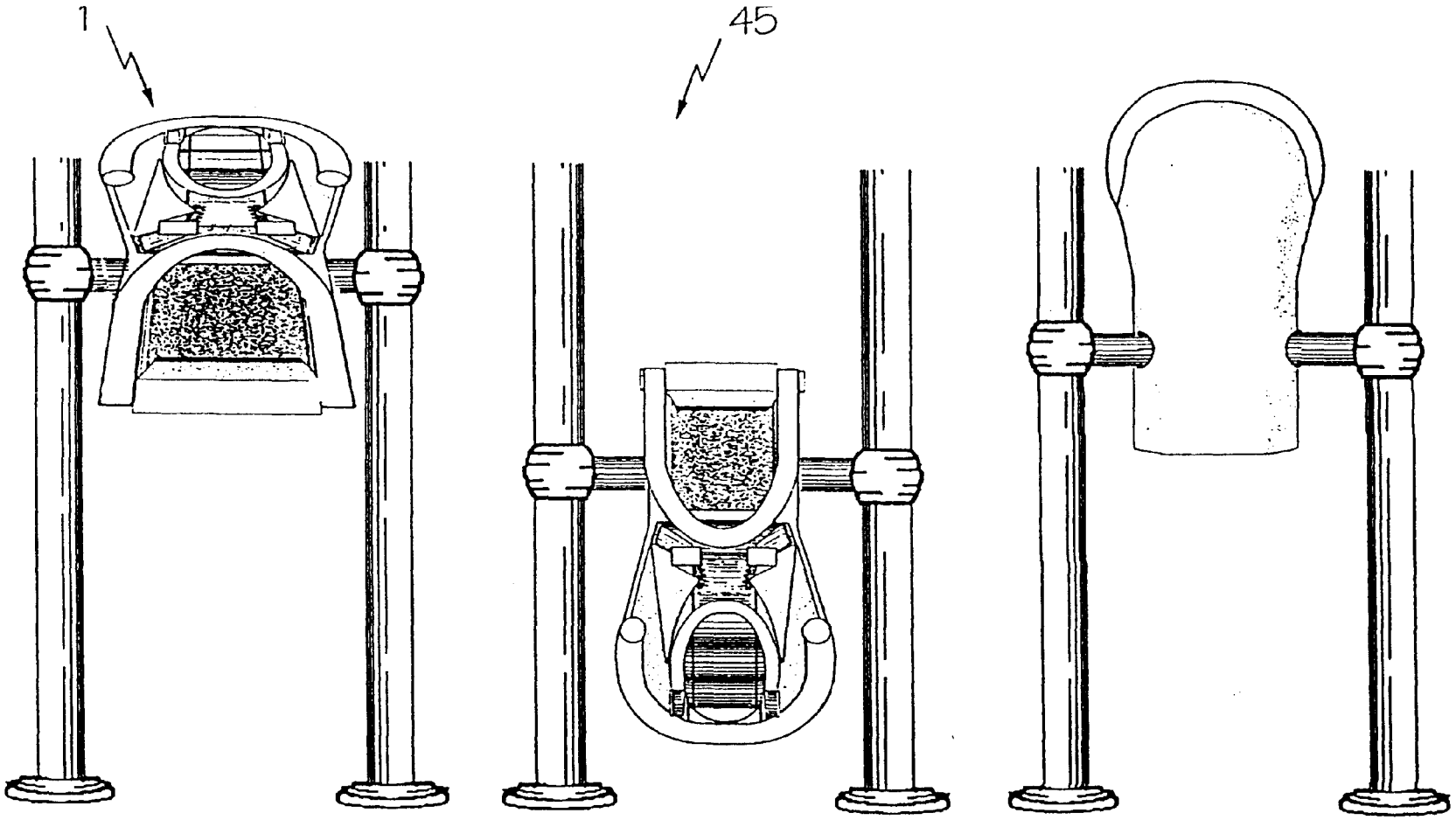
FIG. 12 is a front view of a pod as depicted in FIG. 2 which is configured for a single rider and which is installed upon two vertically moving poles of a carrousel.

FIG. 12 is a front view of Pod 1, as depicted in FIG. 2, which is configured for a single rider, and which is installed upon a carousel 45.

Figure 13:
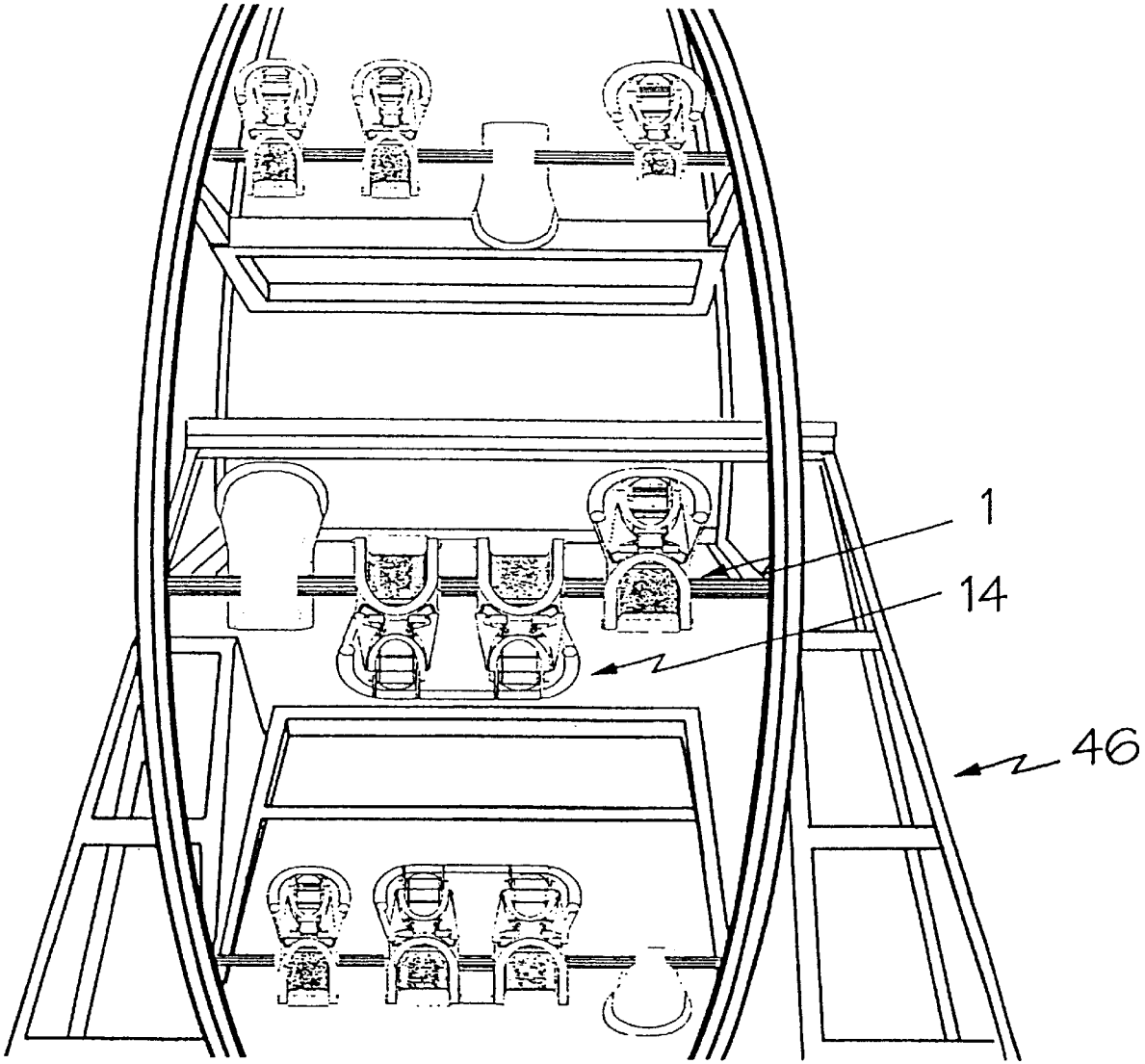
FIG. 13 is a front view of a pod as depicted in FIG. 2, and a front view of a pod as depicted in FIG. 6 which is configured for two riders and which is installed upon an arm of a Ferris wheel.

FIG. 13 is a front view front of Pod 1, as depicted in FIG. 2, and of Double Pod 14 pod as depicted in FIG. 6, and which is installed upon an arm of a Ferris wheel 46.

Figure 14:
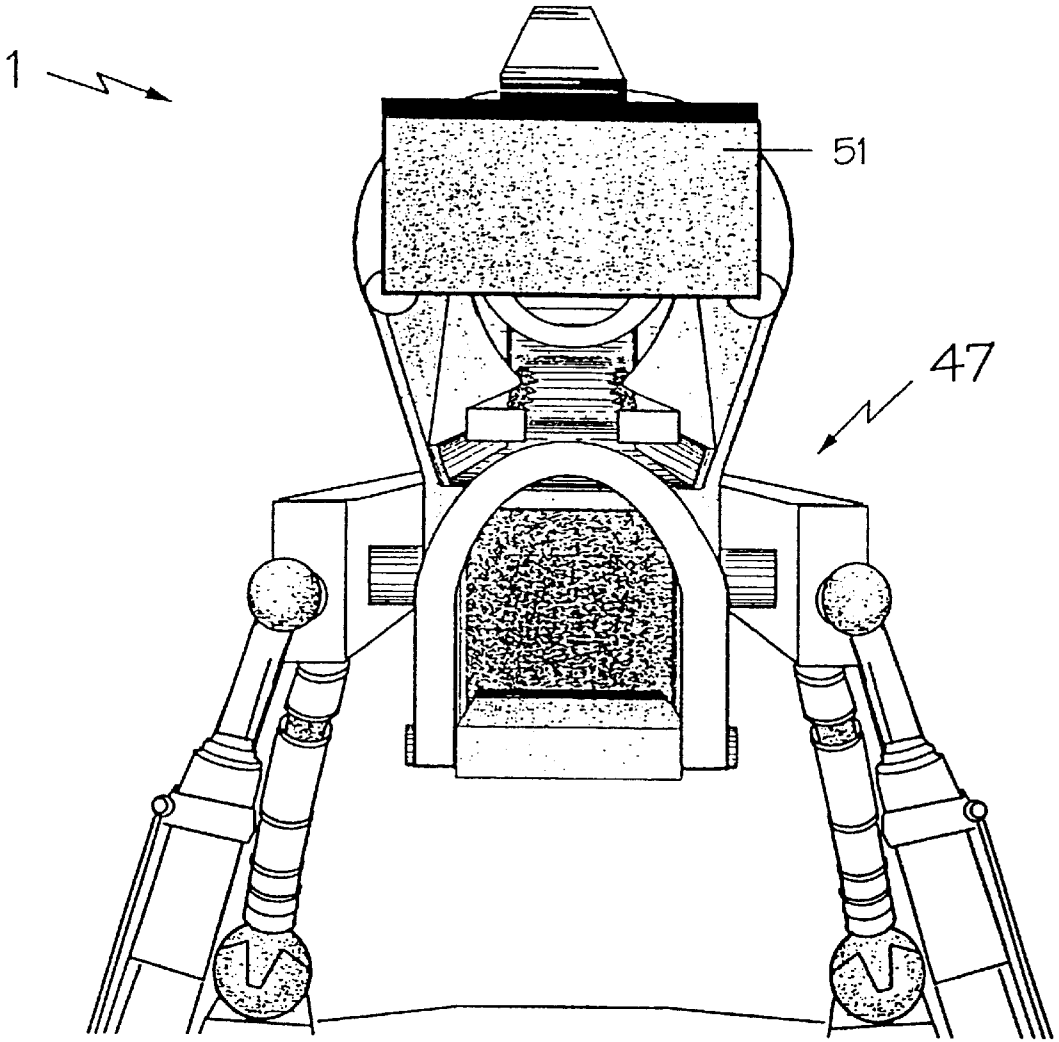
FIG. 14 is a front view front of a pod as depicted in FIG. 2 which is configured for a single rider and which is installed upon the four legs of a virtual reality device which displays computer generated images on a screen placed in front of the rider's point of view.

FIG. 14 is a front view front of Pod 1, as depicted in FIG. 2, which is configured for a single rider, and which is installed upon the four legs of a virtual reality device 47 which displays computer generated images on screen 51 placed in front of the rider's point of view.

Figure 15:
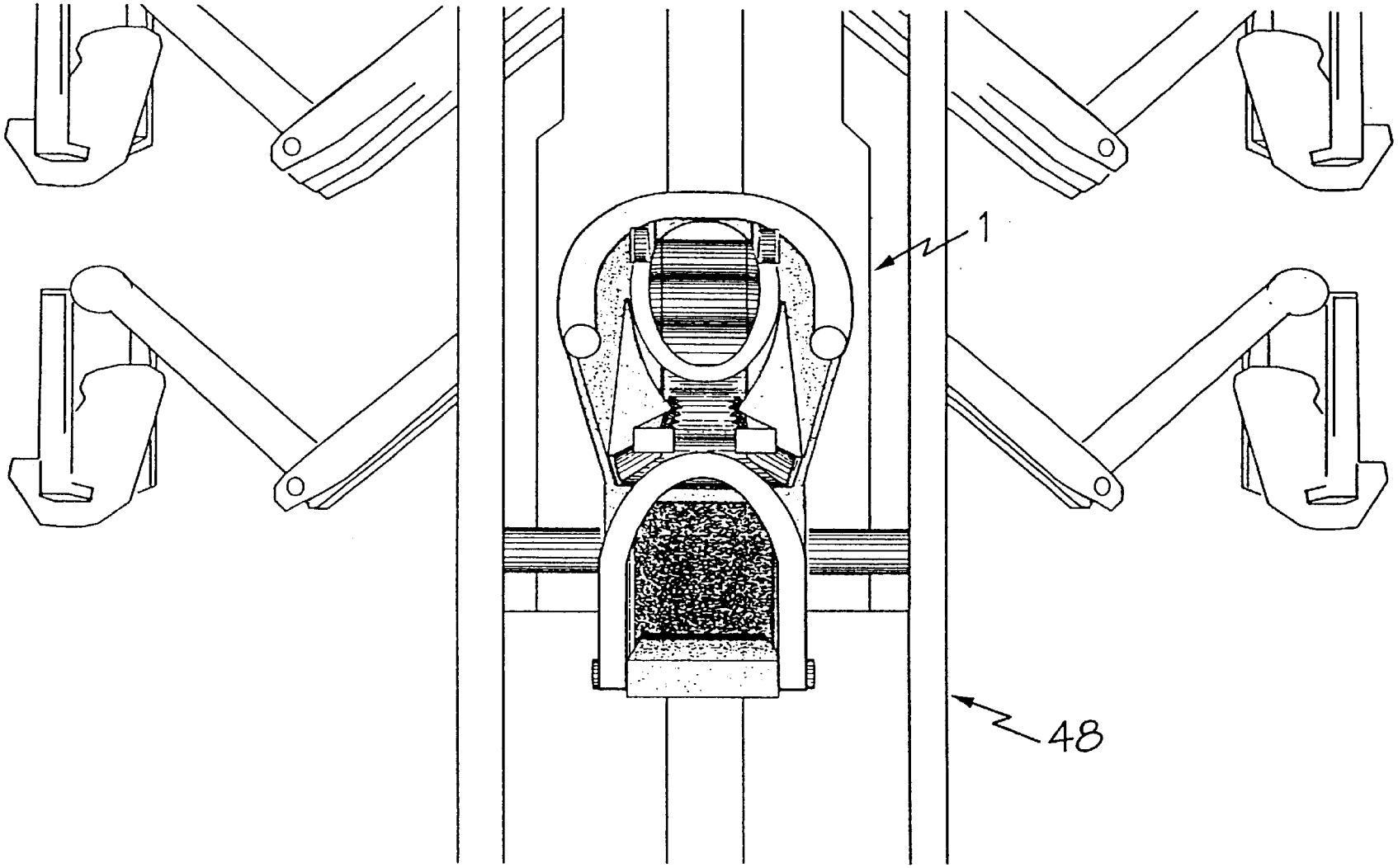
FIG. 15 is a front view of a pod as depicted in FIG. 2 which is configured for a single rider and which is installed upon one leg and carriage of a large centrifugal spinning device.

FIG. 15 is a front view of Pod 1 as depicted in FIG. 2, which is configured for a single rider, and which is installed upon one leg and carriage of a large centrifugal spinning device 48.

Figure 16:
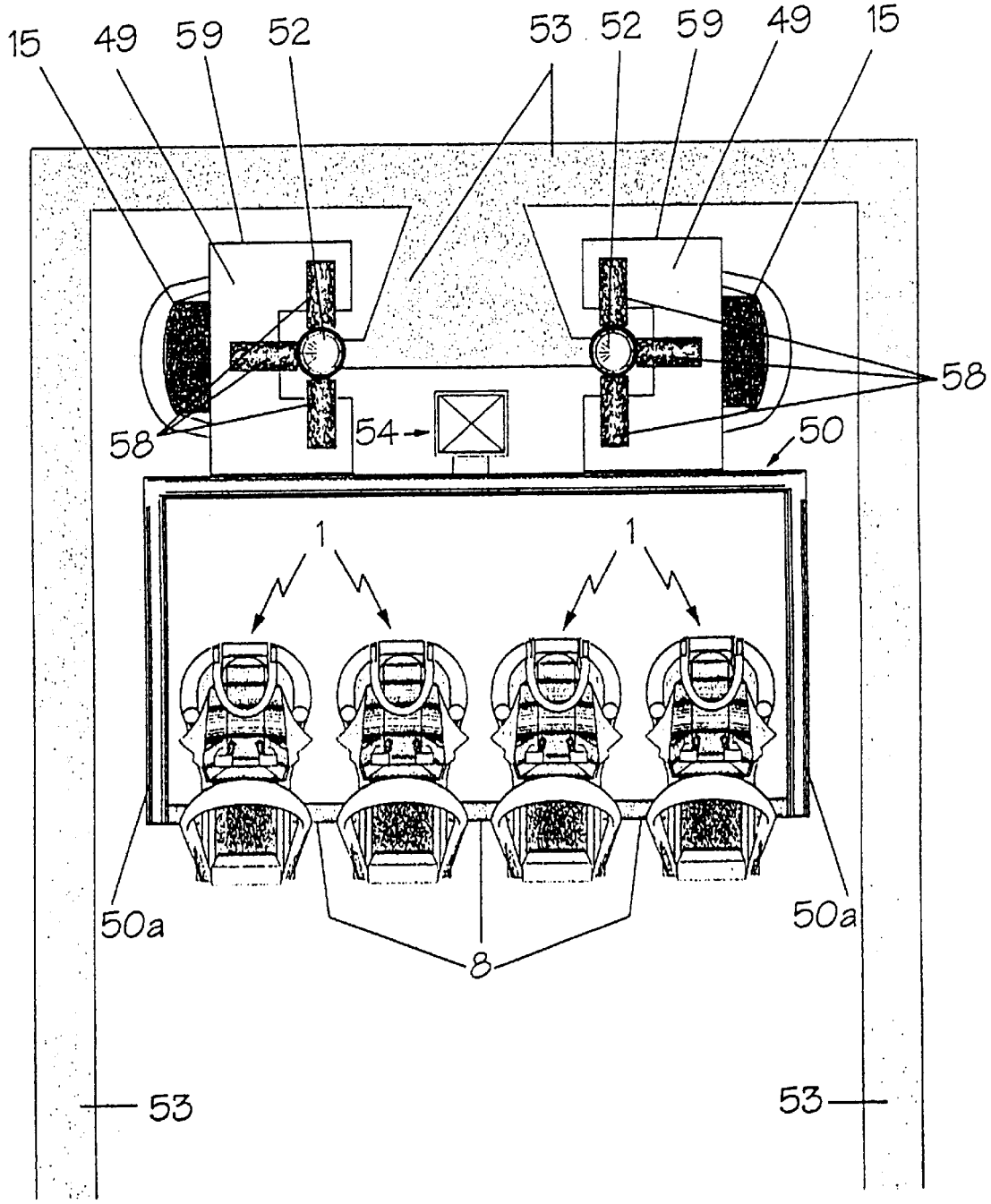
FIG. 16 is a front view of a set of four (4) pods which are configured for single riders and which are installed under the carriage of a suspended looping roller coaster and which are attached to said carriage by a frame which has two outside arms.

FIG. 16 illustrates a set of four Pods 1 which are installed under carriage 59 of a suspended looping roller coaster, which is comprised of two bogies 49 and wheel sets 58, and which are attached to carriage 59 by frame 50, which has two outside arms 50*a.* Outside arms 50*a* are attached to axle 8. Pods 1 rotate about axle 8. Wheel sets 58 of the two bogies 49 ride upon rails 52, which are supported and suspended by the roller coaster track support system 53. Carriage 59 is attached to other carriages 59 by linkage arm 54.

Figure 17:
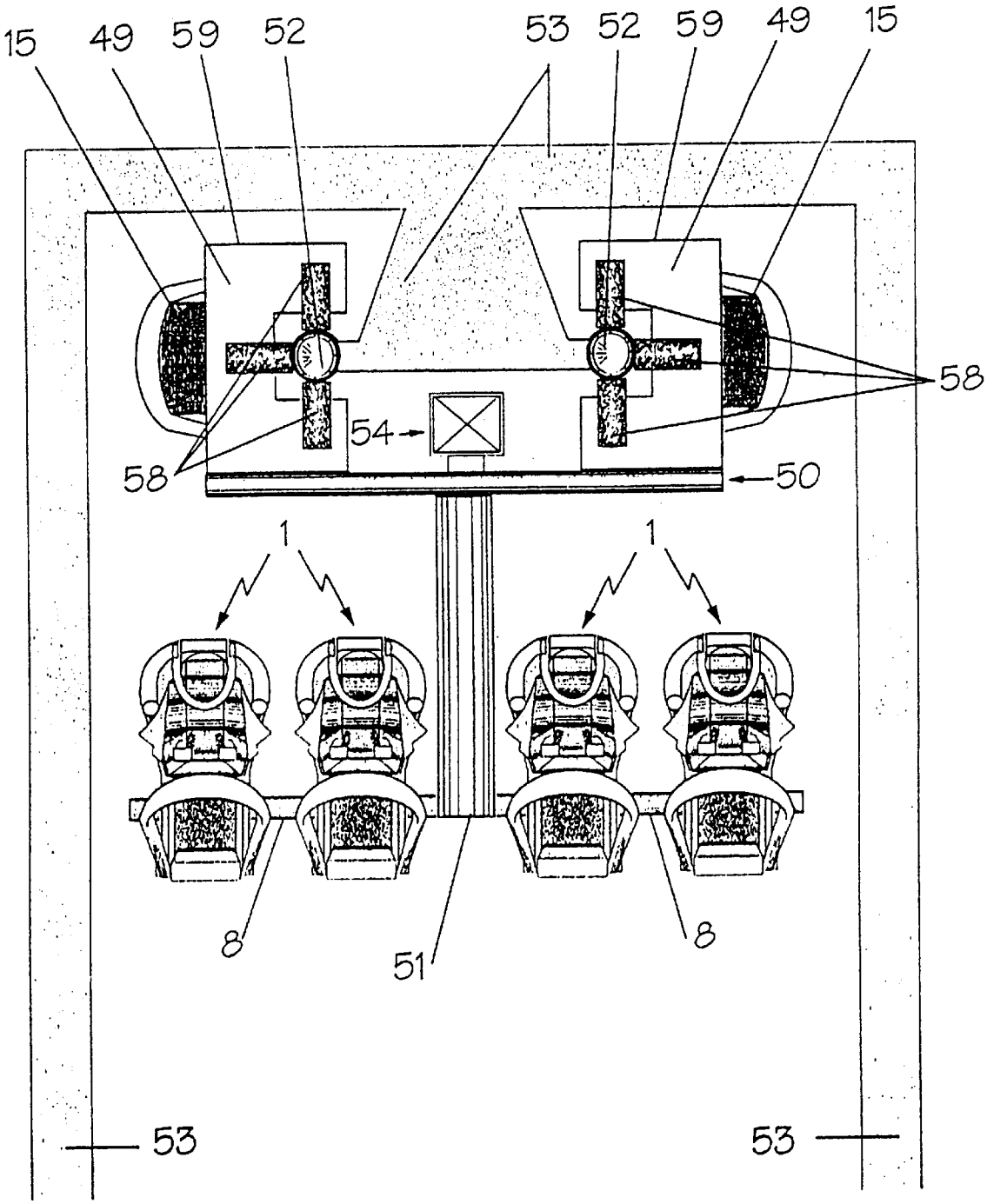
FIG. 17 is a front view of a set of four (4) pods which are configured for single riders and which are installed under the carriage of a suspended looping roller coaster and which are attached to said carriage by a single central arm.

FIG. 17 is a variation of FIG. 16 and illustrates a set of four Pods 1 which are installed under carriage 59 of a suspended looping roller coaster, and which are attached to carriage 59 by frame 50, which has one central inside arm 51. Central inside arm 51 is attached to axle 8. Pods 1 rotate about axle 8. Wheel sets 58 of the two bogies 49 ride upon rails 52, which are supported and suspended by the roller coaster track support system 53. Carriage 59 is attached to other carriages 59 by linkage arm 54.

Figure 18:
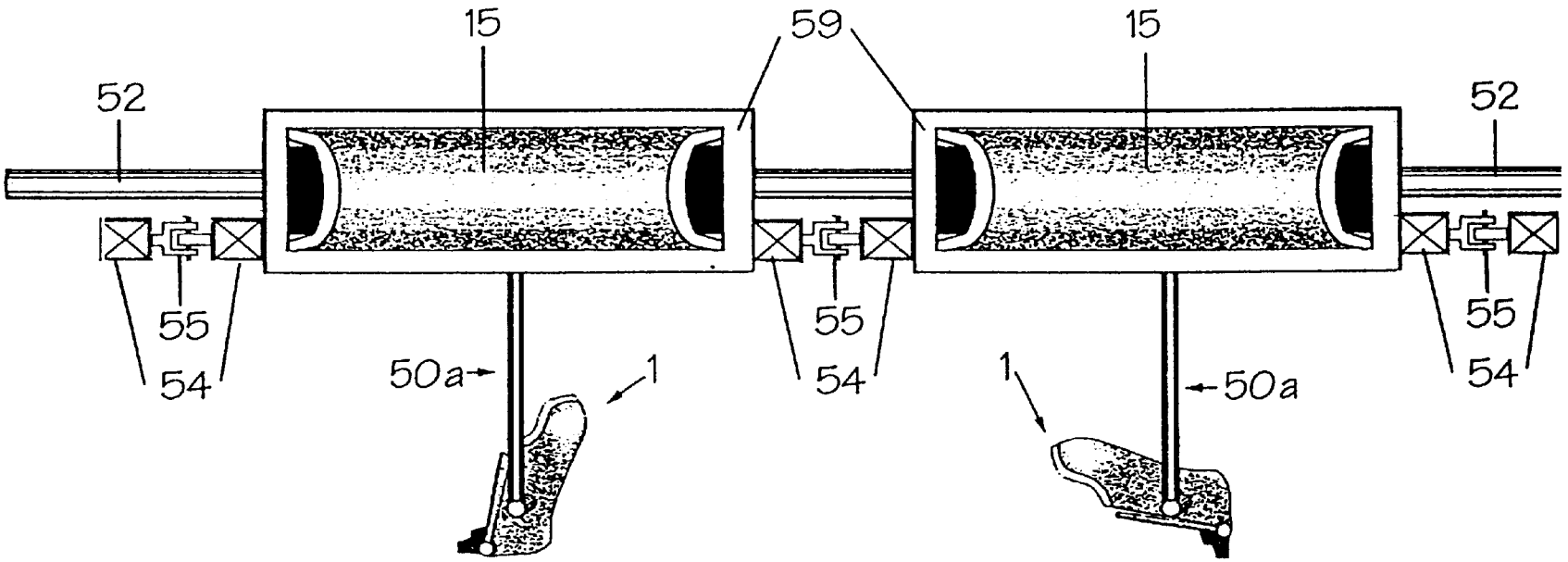
FIG. 18 is a side view of the suspended looping roller coaster depicted in FIG. 16.

FIG. 18 illustrates a side view of FIG. 16, which is comprised of a set of Pods 1 installed below carriage 59 of a suspended looping roller coaster. Pods 1 are attached to carriage 59 by frame 50, which has two outside arms 50*a*. Carriage 59 rides upon rails 52. Carriage 59 is attached to other carriages 59 by carriage linkage arms 54 and secured by carriage link pins 55. Arms 50*a* may either be fixed to carriage 59 or may swing below carriage 59.

Figure 19:
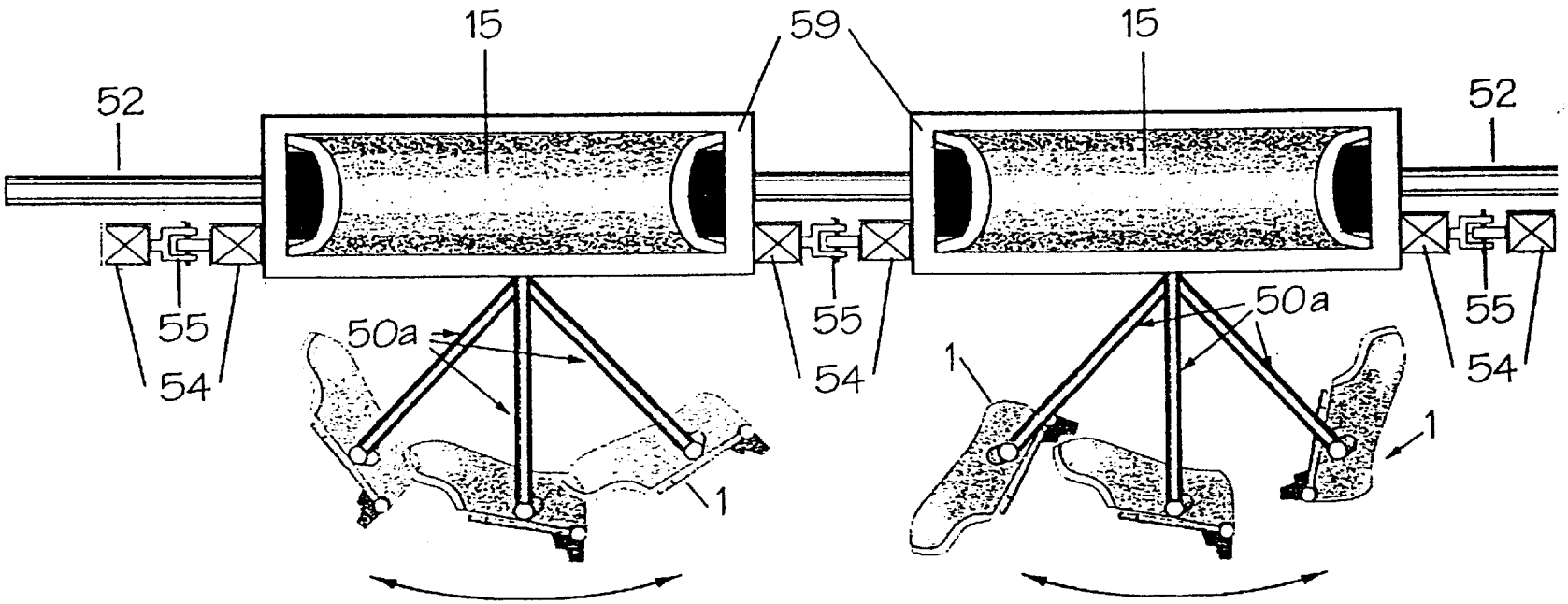
FIG. 19 is a side view of the suspended looping roller coaster device depicted in FIG. 16, and which depicts the motion achievable by swinging the arms of the frame.

FIG. 19 is similar to FIG. 18, and shows frame 50 and arms 50*a* in a swinging motion, both forward and back, relative to the direction of travel of carriage 59. FIG. 19 also shows Pods 1 spinning about axle 8 as arms 50*a* swing forward and backward.

Figure 20:
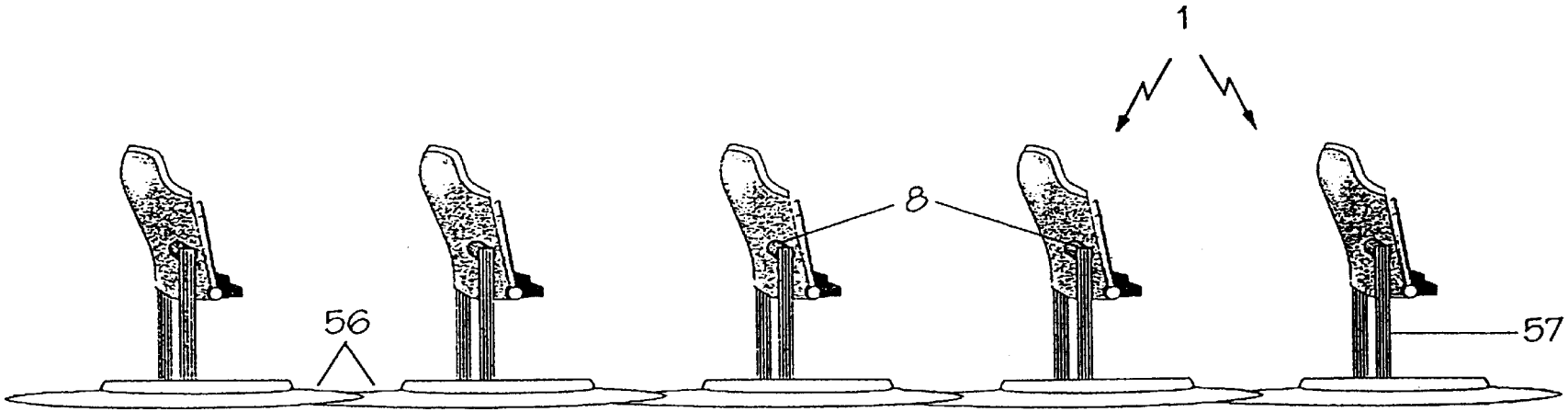
FIG. 20 is a side view of a set of pods which are suspended above, and attached to, a moving sidewalk that has the capacity to partially rotate individual segments of the sidewalk while the sidewalk is moving either forwards or backwards.

FIG. 20 illustrates a side view of individual Pods 1 which are suspended by legs 57 above moving sidewalk 56, which has the capacity to partially rotate individual sidewalk segments from side-to-side while sidewalk 56 moves forward.

Figure 21:
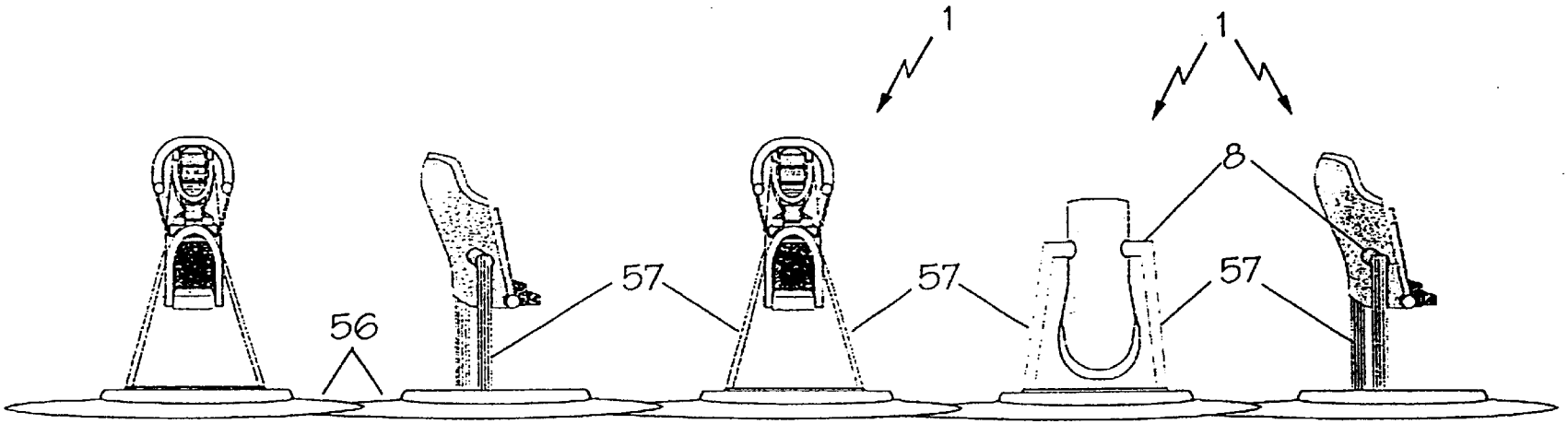
FIG. 21 is similar to FIG. 20 with the addition that FIG. 21 shows some of the potential turning and spinning motion configurations that could be experienced by riders of such a moving sidewalk.

FIG. 21 is similar to FIG. 20, and shows the ability of individual segments of sidewalk 56 to rotate from side-to-side, as well as for individual Pods 1 to rotate about axle 8 as sidewalk 56 moves forward.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. A roller coaster ride, comprising:

a. a carriage having first and second opposing outwardly facing sides;

b. a track along which said carriage is adapted to travel in a predetermined direction of travel;

c. a first set of seats interconnected outwardly to said first outwardly facing side of said carriage for 360 degree rotation about a longitudinal axis that extends transverse to said direction of travel; and d. a second set of seats interconnected outwardly to said second outwardly facing side of said carriage for 360 degree rotation about said longitudinal axis.

2. A roller coaster ride, comprising:

a. a carriage having first and second opposing outwardly facing sides b. a track along which said carriage is adapted to travel in a predetermined direction of travel;

c. first and second seats mounted outwardly to said first outwardly facing side of said carriage for 360 degree rotation about a longitudinal axis that extends transverse to said direction of travel, said first and second seats being laterally spaced relative to one another along said longitudinal axis; and d. third and fourth seats mounted outwardly to said second outwardly facing side of said carriage for 360 degree rotation about said longitudinal axis, said third and fourth seats being laterally spaced relative to one another along said longitudinal axis.

3. A roller coaster ride, comprising:

a. a carriage having first and second opposing sides with first and second outwardly facing surfaces, respectively;

b. a track along which said carriage is adapted to travel in a predetermined direction of travel;

c. a first set of seats interconnected to said first side of said carriage for 360 degree rotation about a longitudinal axis that extends transverse to said direction of travel, and positioned exteriorly to said first outwardly facing surface; and d. a second set of seats interconnected to said second side of said carriage for 360 degree rotation about said longitudinal axis, and positioned exteriorly to said second outwardly facing surface.

4. A roller coaster ride, comprising;

a. a carriage having first and second opposing sides with first and second outwardly facing surfaces, respectively;

b. a track along which said carriage is adapted to travel in a predetermined direction of travel;

c. first and second seats mounted to said first side of said carriage for 360 degree rotation about a longitudinal axis that extends transverse to said direction of travel, said first and second seats being laterally spaced relative to one another along said longitudinal axis, said first seat positioned exteriorly to said first outwardly facing surface; and d. third and fourth seats mounted to said second side of said carriage for 360 degree rotation about said longitudinal axis, said third and fourth seats being laterally spaced relative to one another along said longitudinal axis, said third seat positioned exteriorly to said second outwardly facing surface.

* * * * *